US009178324B2

(12) United States Patent
Beldock et al.

(10) Patent No.: US 9,178,324 B2
(45) **Date of Patent: *Nov. 3, 2015**

(54) ELECTRIC PLUG SYSTEM

(71) Applicant: BelPower Systems LLC, New York, NY (US)

(72) Inventors: Gwen Beldock, Pacific Palisades, CA (US); Donald T. Beldock, New York, NY (US); James Bleck, Chelmsford, MA (US); William Chura, Newton, MA (US); Thomas Eagan, Jr., Chelmsford, MA (US); Jonathan Towle, Amherst, NH (US); Scott Wakefield, Andover, MA (US)

(73) Assignee: BELPOWER SYSTEMS LLC, New York, NY (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/192,598

(22) Filed: Feb. 27, 2014

(65) Prior Publication Data

US 2014/0248795 A1 Sep. 4, 2014

Related U.S. Application Data

(63) Continuation-in-part of application No. 13/849,621, filed on Mar. 25, 2013.

(60) Provisional application No. 61/721,795, filed on Nov. 2, 2012.

(51) Int. Cl.

| | |
|---|---|
| ***H01R 25/00*** | (2006.01) |
| *H01R 13/60* | (2006.01) |
| *H01R 24/78* | (2011.01) |

(52) U.S. Cl.

CPC ..... *H01R 25/006* (2013.01); *H01R 13/60* (2013.01); *H01R 24/78* (2013.01)

(58) Field of Classification Search

CPC ..... H01R 13/70; H01R 31/02; H01R 31/06; H01R 25/003; H01R 25/006; H01R 13/6658; G02B 6/3817; G02B 6/4201; H01L 27/3276; H01L 51/5228

USPC ..... 439/652, 577, 542, 543; 320/115; 362/410

See application file for complete search history.

(56) References Cited

U.S. PATENT DOCUMENTS 1,511,206 A * 10/1924 Cuthbert ..... 439/542
1,767,262 A * 6/1930 Schmitz ..... 318/8

(Continued)

OTHER PUBLICATIONS

Vertical Stand Universal 3x4 Power Sockets (AC 250V), Product Description, DealExtreme, available at http://www.dealextreme.com/p/vertical-stand-universal-3x4-power-sockets-ac-250v-72958, downloaded Sep. 13, 2011.

(Continued)

*Primary Examiner* — Abdullah Riyami
*Assistant Examiner* — Vladimir Imas
(74) *Attorney, Agent, or Firm* — Gordon & Jacobson, PC

(57) ABSTRACT

An electric plug system includes a stabilizing base constructed to stand on a horizontal floor surface, a vertical support element supported by and extending from the base and defining a vertical axis, and an electrical socket block coupled to a top portion of the vertical support element and supported thereby. The electrical socket block has a plurality of electrical sockets constructed to receive the plugs of the devices. Also, the system includes an electrical wire extending from the horizontal electrical socket block, down the vertical support element, and along or through the base and there-beyond, the electrical wire terminating in an electrical plug constructed to plug into the wall or floor electrical outlet. The system can include a device holder removably attached to the vertical support element. The base can include a first base portion and a second base portion removably attached to one another.

24 Claims, 6 Drawing Sheets

(56) References Cited

U.S. PATENT DOCUMENTS

| | | | | |
|---|---|---|---|---|
| 2,261,857 | A * | 11/1941 | Novak et al. | 174/72 B |
| 2,429,553 | A * | 10/1947 | Jasinski | 362/410 |
| 1,176,262 | A | 6/1960 | Schmitz | |
| 3,256,510 | A * | 6/1966 | Van Horssen | 439/724 |
| 3,317,884 | A | 5/1967 | Lynch | |
| 3,725,696 | A * | 4/1973 | Morton | 362/399 |
| 3,801,810 | A * | 4/1974 | Smith | 362/410 |
| 3,871,730 | A | 3/1975 | Hesse | |
| 4,284,840 | A * | 8/1981 | Baker | 174/493 |
| 4,373,111 | A | 2/1983 | Myers et al. | |
| 4,780,571 | A | 10/1988 | Huang | |
| 5,199,905 | A | 4/1993 | Fillinger | |
| 5,230,552 | A | 7/1993 | Schipper et al. | |
| 5,236,374 | A | 8/1993 | Leonard et al. | |
| 5,284,255 | A | 2/1994 | Foster et al. | |
| 5,393,226 | A | 2/1995 | Groom | |
| 5,495,811 | A | 3/1996 | Carson et al. | |
| 5,595,494 | A | 1/1997 | Wiebe | |
| 5,776,559 | A | 7/1998 | Woolford | |
| 5,819,405 | A | 10/1998 | Marder et al. | |
| 5,899,761 | A | 5/1999 | Crane et al. | |
| 6,017,228 | A | 1/2000 | Verbeek et al. | |
| 6,265,969 | B1 * | 7/2001 | Shih | 340/468 |
| 6,364,678 | B1 * | 4/2002 | Hellwig et al. | 439/211 |
| 6,422,884 | B1 | 7/2002 | Babasick et al. | |
| 6,430,882 | B1 | 8/2002 | Feldpausch et al. | |
| 6,548,987 | B1 * | 4/2003 | Oster et al. | 320/114 |
| 6,551,130 | B2 | 4/2003 | Bonilla | |
| 6,593,528 | B2 | 7/2003 | Franklin-Lees et al. | |
| 6,655,816 | B2 * | 12/2003 | Wu | 362/655 |
| 6,805,581 | B2 | 10/2004 | Love | |
| 6,883,942 | B2 * | 4/2005 | Denningham | 362/414 |
| 6,897,379 | B1 | 5/2005 | Hsiao | |
| 6,899,441 | B2 * | 5/2005 | Chen | 362/102 |
| 7,004,786 | B1 | 2/2006 | Bloom et al. | |
| 7,021,961 | B1 | 4/2006 | Soderholm | |
| 7,041,899 | B2 * | 5/2006 | Stekelenburg | 174/50 |
| 7,060,040 | B2 | 6/2006 | Farmer | |
| 7,091,417 | B1 * | 8/2006 | Jur et al. | 174/68.2 |
| 7,341,463 | B2 | 3/2008 | Lai | |
| 7,390,977 | B2 * | 6/2008 | Hill | 174/480 |
| 7,557,297 | B2 | 7/2009 | Axland et al. | |
| 7,626,119 | B2 * | 12/2009 | Axland et al. | 174/53 |
| 7,645,935 | B1 * | 1/2010 | Picard, Jr. | 174/50 |
| 7,782,223 | B2 * | 8/2010 | Lang et al. | 340/815.45 |
| 7,821,777 | B2 | 10/2010 | Chih | |
| 7,905,749 | B2 | 3/2011 | Cleveland | |
| 7,963,797 | B2 * | 6/2011 | Knappe | 439/534 |
| 8,002,586 | B2 | 8/2011 | Fleisig | |
| 8,070,524 | B2 | 12/2011 | Gencarelli | |
| 8,080,975 | B2 * | 12/2011 | Bessa et al. | 320/114 |
| 8,110,743 | B2 | 2/2012 | Drane | |
| 8,193,658 | B2 | 6/2012 | Fleisig | |
| 8,330,041 | B2 | 12/2012 | Axland et al. | |
| 8,336,839 | B2 | 12/2012 | Boccoleri et al. | |
| 8,485,111 | B2 | 7/2013 | Chinuki et al. | |
| 8,485,699 | B2 * | 7/2013 | Reda, Jr. | 362/401 |
| 8,497,657 | B2 * | 7/2013 | Franks et al. | 320/108 |
| 8,587,261 | B2 * | 11/2013 | Sassen et al. | 320/162 |
| 8,723,055 | B2 | 5/2014 | Beldock et al. | |
| 8,740,627 | B1 | 6/2014 | Rosenblum | |
| 2003/0007360 | A1 | 1/2003 | Hsieh | |
| 2011/0139945 | A1 * | 6/2011 | Fahrberger et al. | 248/121 |
| 2011/0154975 | A1 | 6/2011 | Belitz et al. | |
| 2011/0197466 | A1 | 8/2011 | Shami et al. | |
| 2011/0197794 | A1 | 8/2011 | Nunes | |
| 2013/0126540 | A1 * | 5/2013 | Vesterby | 220/737 |

OTHER PUBLICATIONS

Activity Products Specification Guide, Jul. 2002 (see pp. 10, 11, and 28).

* cited by examiner

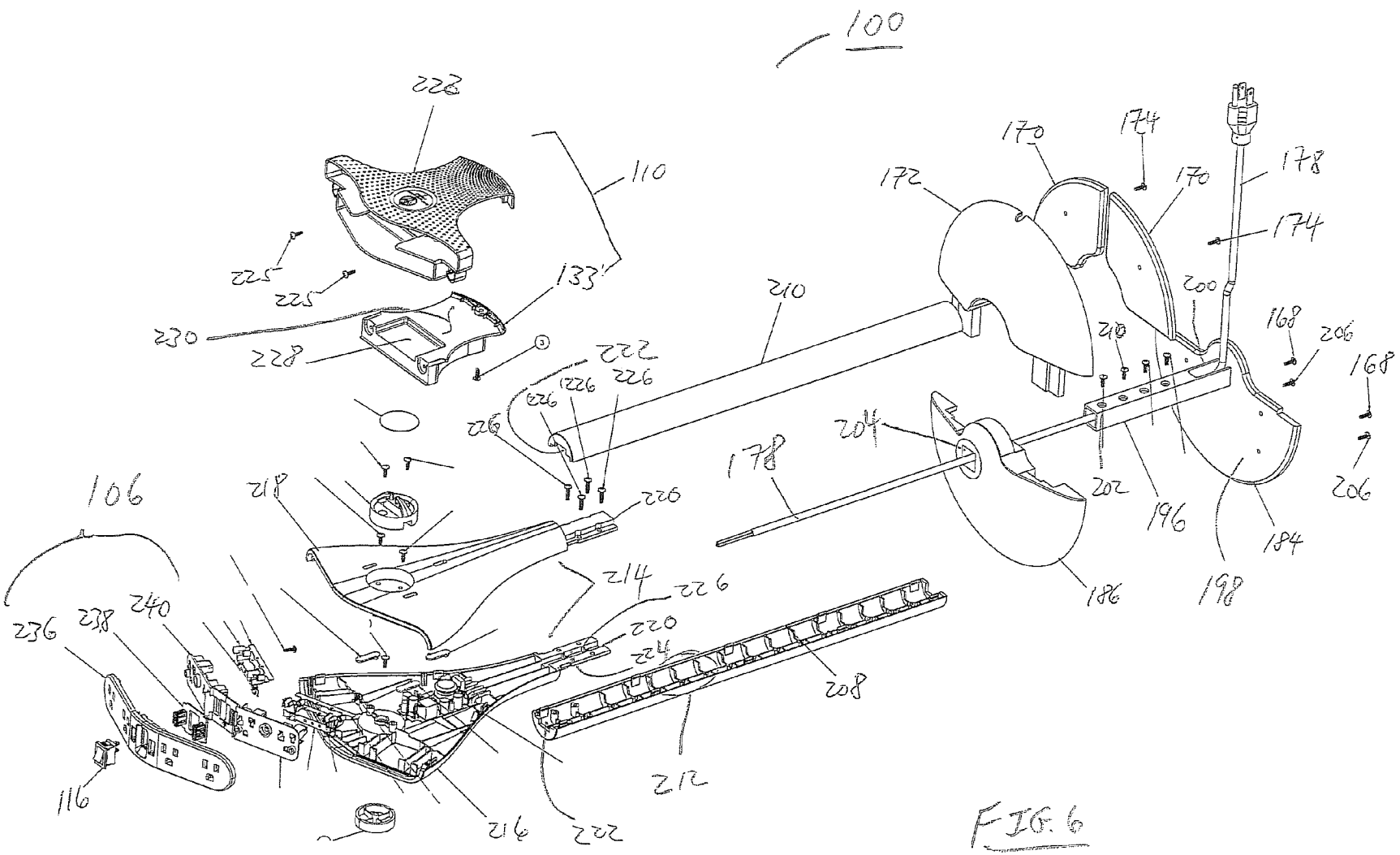
100
110
178
174
168
206
184
198
200
170
196
202
182
204
192
178
210
208
212
222
226
228
230
232
242
240
232
234
232
232
232

ELECTRIC PLUG SYSTEM

CROSS-REFERENCE TO RELATED APPLICATIONS

This application is a continuation-in-part of U.S. patent application Ser. No. 13/849,621 filed on Mar. 25, 2013, the entire contents of which are incorporated by reference herein.

BACKGROUND OF THE INVENTION

1. Field of the Invention

The subject disclosure relates to multi-outlet electrical power source connections. More particularly, the subject disclosure relates to electrical plug systems that are easily usable by users whose flexibility and/or strength has been impaired by handicap, age, illness, or injury.

2. State of the Art

Power strips having a plug, a power cord, and block of electrical sockets (outlets) are ubiquitous in the modern home, office, and other facilities where multiple plug-in electrically powered devices, machines or equipment are utilized. The electrical sockets of the power strip are typically arranged in one or two rows. A power strip generally includes a circuit breaker or surge (overload) protector that safely limits the electric current flowing through the strip and prevents surges of current that can damage the equipment which receives power through a power strip outlet. The power strip also generally includes an on-off switch that turns the power strip on and off, thereby preventing current from reaching the outlets. If desired, each outlet may have its own switch. The switch is often illuminated. Many power strips also include sensor circuits that can detect the level of current flowing through a socket, and if the socket is not "active", will place the socket in standby mode in order to reduce current consumption.

Power strips are used by plugging the plug into a convenient wall or floor outlet, and by plugging the plugs of multiple devices into the electrical sockets of the power strip. In order to make the connection between the devices and the power strip outlets, the user often must crawl under a desk, table, or other furniture.

SUMMARY OF THE INVENTION

According to one aspect, an electric plug system is provided and includes a stabilizing base constructed to stand on a horizontal floor surface, a vertical support element supported by and extending from the base and defining a vertical axis, and an electrical socket block coupled to a top portion of the vertical support element and supported thereby. The electrical socket block has a plurality of electrical sockets constructed to receive the plugs of the devices. The system also includes a device holder removably attached to the vertical support element. The holder is constructed to hold at least one of the powering electrically powered devices. Also, the system includes an electrical wire extending from the horizontal electrical socket block, down the vertical support element, and along or through the base and there-beyond, the electrical wire terminating in an electrical plug constructed to plug into the wall or floor electrical outlet.

According to a second aspect, an electric plug system is provided that includes a reconfigurable stabilizing base constructed to stand on a horizontal floor surface. In a first configuration the stabilizing base includes a first base portion and a second base portion removably attached to one another and in a second configuration the stabilizing base consists of the first base portion detached from the second base portion. The system also includes a vertical support element supported by and extending from the first base portion of the base and defining a vertical axis. Also, the system includes an electrical socket block coupled to a top portion of the vertical support element and supported thereby, the electrical socket block having a plurality of electrical sockets adapted to receive the plugs of the devices. Further, the system includes an electrical wire extending from the horizontal electrical socket block, down the vertical support element, and along or through the base and there-beyond, the electrical wire terminating in an electrical plug constructed to plug into the wall or floor electrical outlet.

BRIEF DESCRIPTION OF THE DRAWINGS

FIG. 6 is an exploded assembly view of the system shown in FIG. 1.

DETAILED DESCRIPTION OF THE PREFERRED EMBODIMENTS

Figure 1:
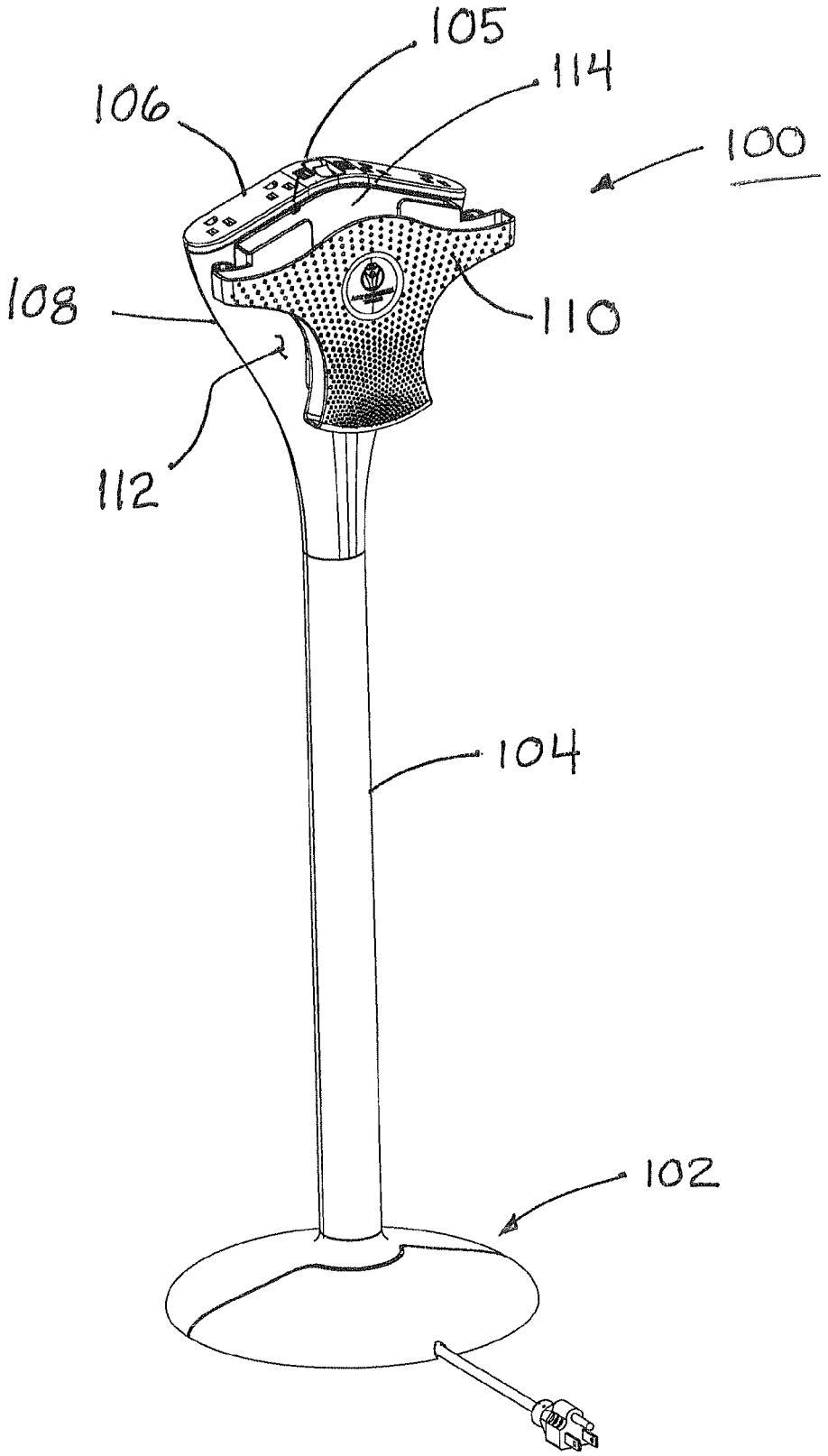
FIG. 1 is a perspective view of an embodiment of an electrical plug system viewed from the top and rear side.

FIG. 1 is a perspective view of an embodiment of an electrical plug system 100 viewed from the top and rear side. The system includes a preferably weighted round base 102, a vertical support 104 centrally disposed in and extending from the base 102, and a socket block 106 extending from an upper end 108 of the vertical support 104. The upper end 108 of the vertical support 104 flares outwards laterally and upwardly and defines a space in which the socket block 106 is received.

A device holder 110 is removably attached to the rear side 112 of the upper end 108 of the vertical support 104. The device holder 110 includes one or more pockets 114 constructed to receive electric devices plugged (not shown) into the socket block 106, such as mobile phones, cameras, and tablet computers. In one embodiment, an upper edge of the device holder 110 is aligned with the socket block 106.

Figure 2:
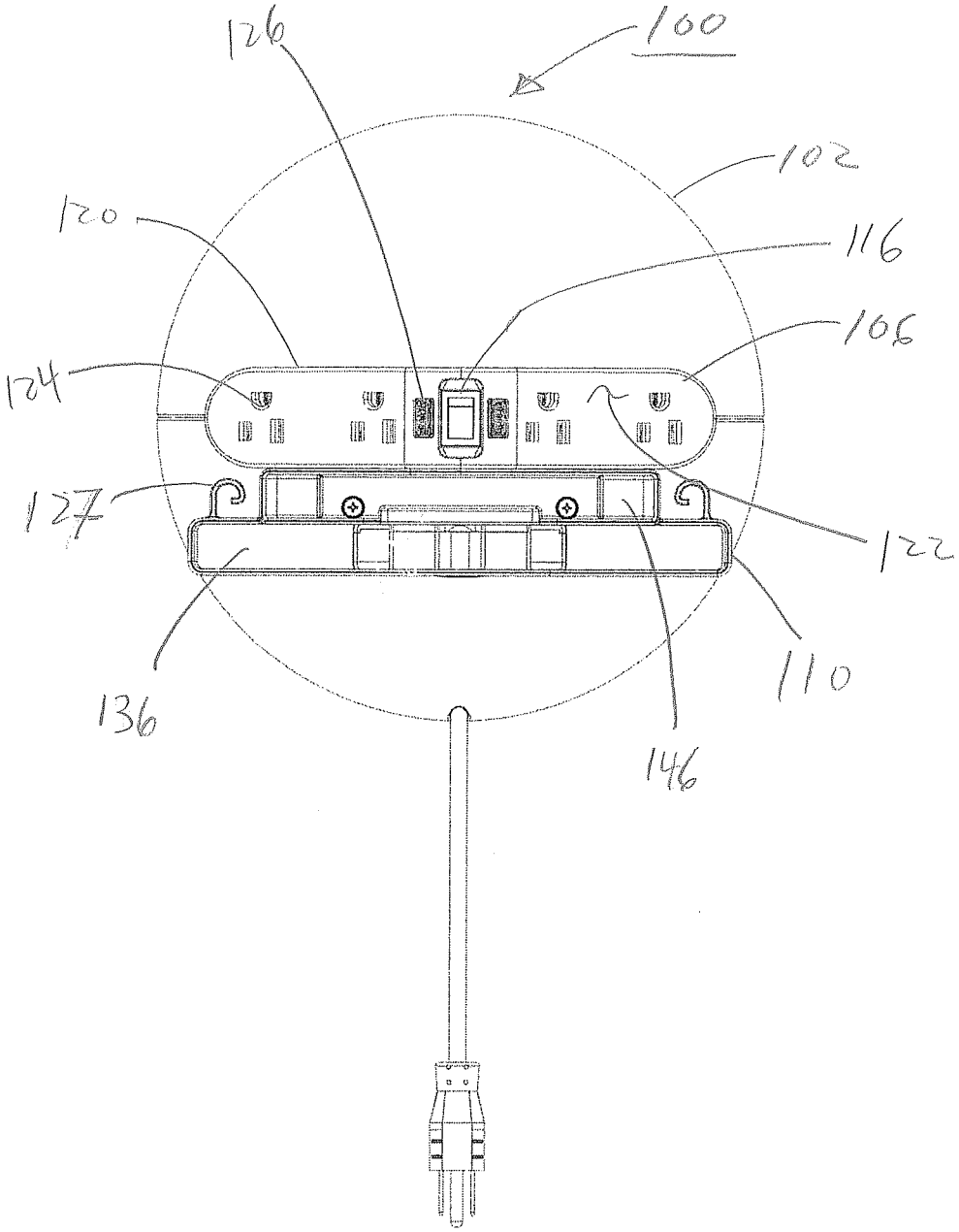
FIG. 2 is a plan view of the electrical plug system shown in FIG. 1.
Figure 5:
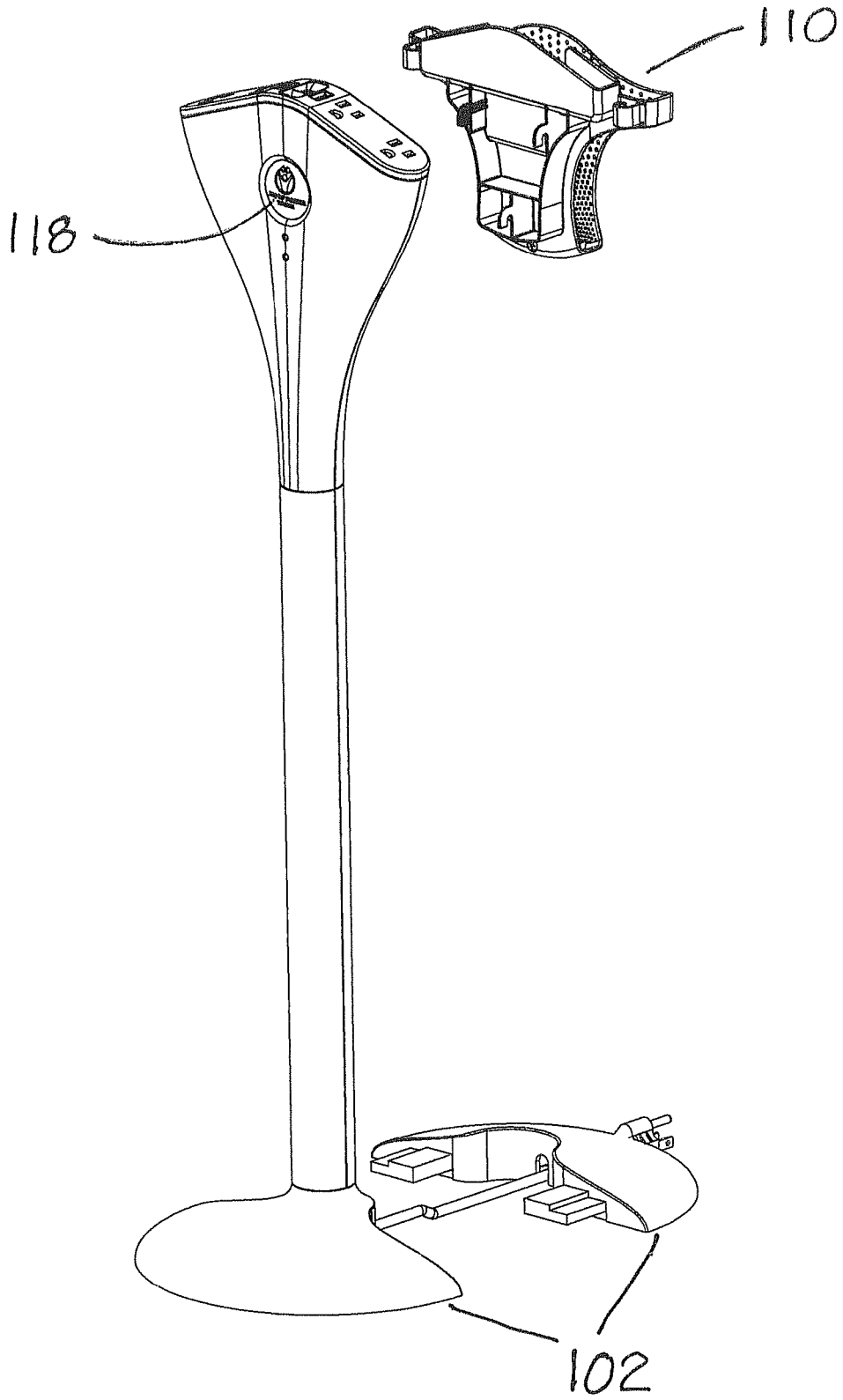
FIG. 5 is a top perspective view of the electrical plug system of FIG. 1 with the device holder and portion of the base disassembled.

FIG. 2 shows a plan view of the electrical plug system 100, and shows additional detail of the socket block 106, device holder 110, and base 102. The socket block 106 includes an on-off power switch 116 at the center of the socket block 106. A small indicator light 118 (FIG. 5) located on the front side 120 of the upper end 108 of the support 104 may be illuminated whenever the power switch 116 is in the on position or may be operated to light independently of the switch position. Alternatively, the light 118 is optionally integrated with the power switch 116. An upper surface 122 of the socket block 106 slopes downward at each side relative to the power switch 116, with e.g., two plugs 124 and one universal serial bus socket 126 on the top of each side. The device holder 110 has cord guides 127 formed as J-shaped hooks. The cord guides 127 define clips that can be resiliently deformed to capture one or more cords connected to devices that are plugged into the socket block 106.

Figure 3A:
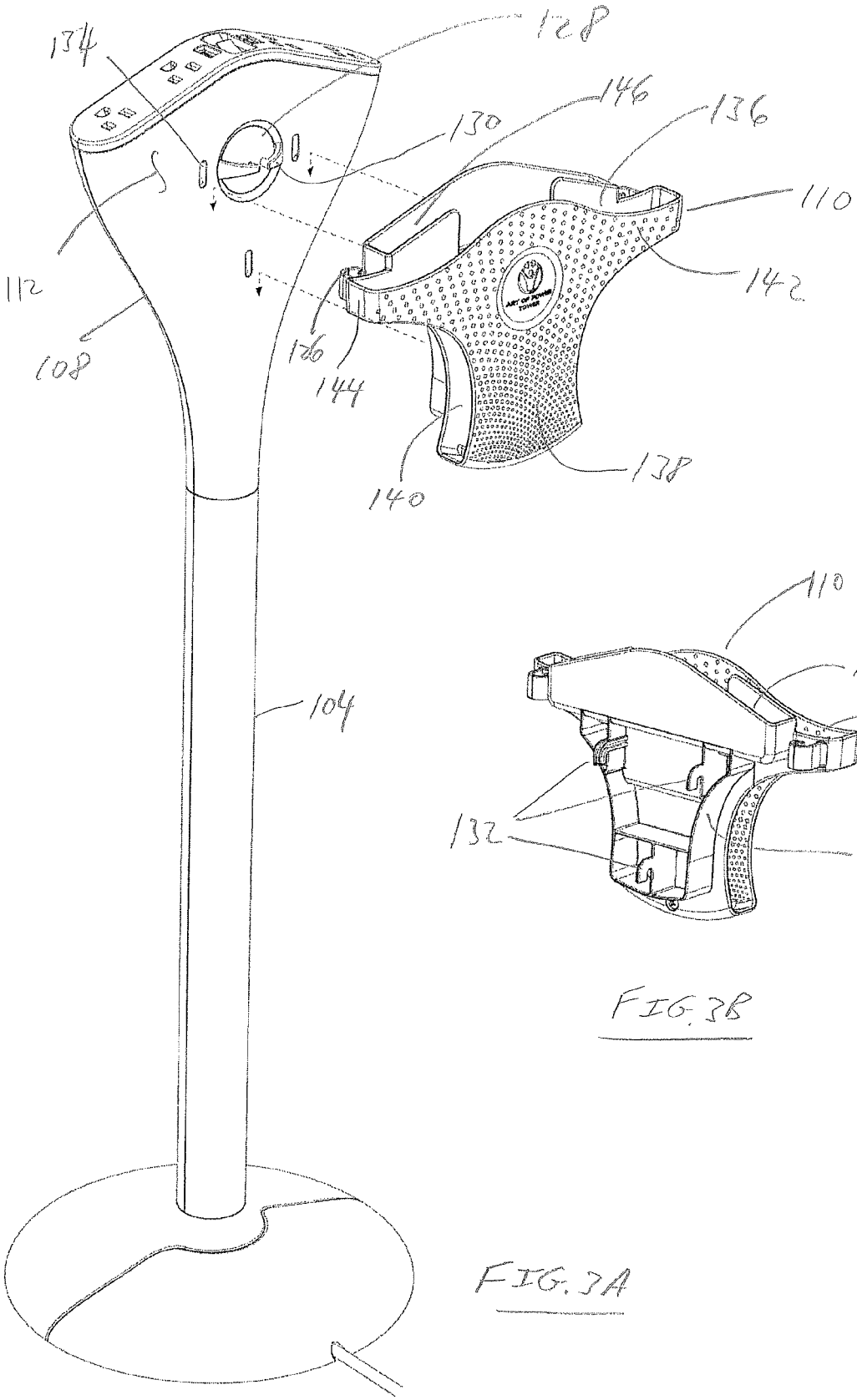
FIG. 3A is a perspective view of the electrical plug system shown in FIG. 1 with a device holder shown detached from the system.

FIG. 3A shows the device holder 110 detached from the upper end 108 of the support 104. When the device holder 110 is detached, another cord guide 128 is exposed at the rear side 112 of the upper end 108 of the support 104. The cord guide 128 defines clips 130 that can be resiliently deformed to capture one or more cords connected to devices that are plugged into the socket block 106.

The device holder 110 has a rear pocket 136 that is defined generally by a T-shaped arrangement. A central vertical section 138 of the rear pocket 136 has open sidewalls 140 that curve upwardly to a horizontal section 142, which has closed sidewalls 144 that form a rim at the upper end of the rear pocket 136. The rear pocket 136 preferably has dimensions suitable to receive a tablet computer, such as an iPad® (manufactured by Apple Inc. of Cupertino, Calif.). The device holder 110 also has a front pocket 146 between the cord guides 127. The front pocket 146 has enclosed sides and is vertically shallower than the rear pocket 136, as shown in greater detail in FIG. 3B. The front pocket 146 may be sized to accommodate devices, such as a cell phone or smart phone (e.g., an Iphone® (manufactured by Apple Inc. of Cupertino, Calif.)), held in the device holder 110 while the devices are connected to the plugs of the socket block 106.

Figure 3B:
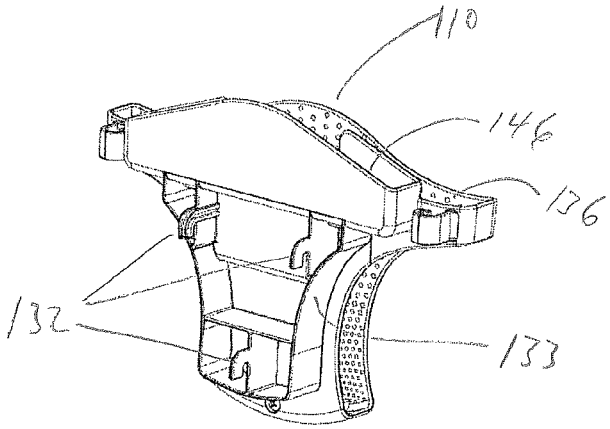
FIG. 3B is a top perspective view of the device holder shown in FIG. 3A.

FIG. 3B shows a view of the device holder 110 from a front and top side. The device holder 110 has a plurality of hooks 132 that are constructed to engage and lock in corresponding slots 134 (FIG. 3A) formed in the rear side 112 of the upper end 108 of the support 104. The hooks 132 extend from flanges of a support rack 133 of device holder 110. To attach the device holder 110 to the upper end 108 of the support 104, the hooks 132 are introduced into the slots 134 and then the device holder 110 is moved downward until the hooks 132 lock into place in slots 134. To detach the device holder 110 from the upper end 108 of the support 104, the device holder 110 is moved upward relative to the upper end 108 of the support 104 to unlock the hooks 132 so that the device holder 110 can be separated from the upper end 108 of the support 104.

Figures 4A, 4B:
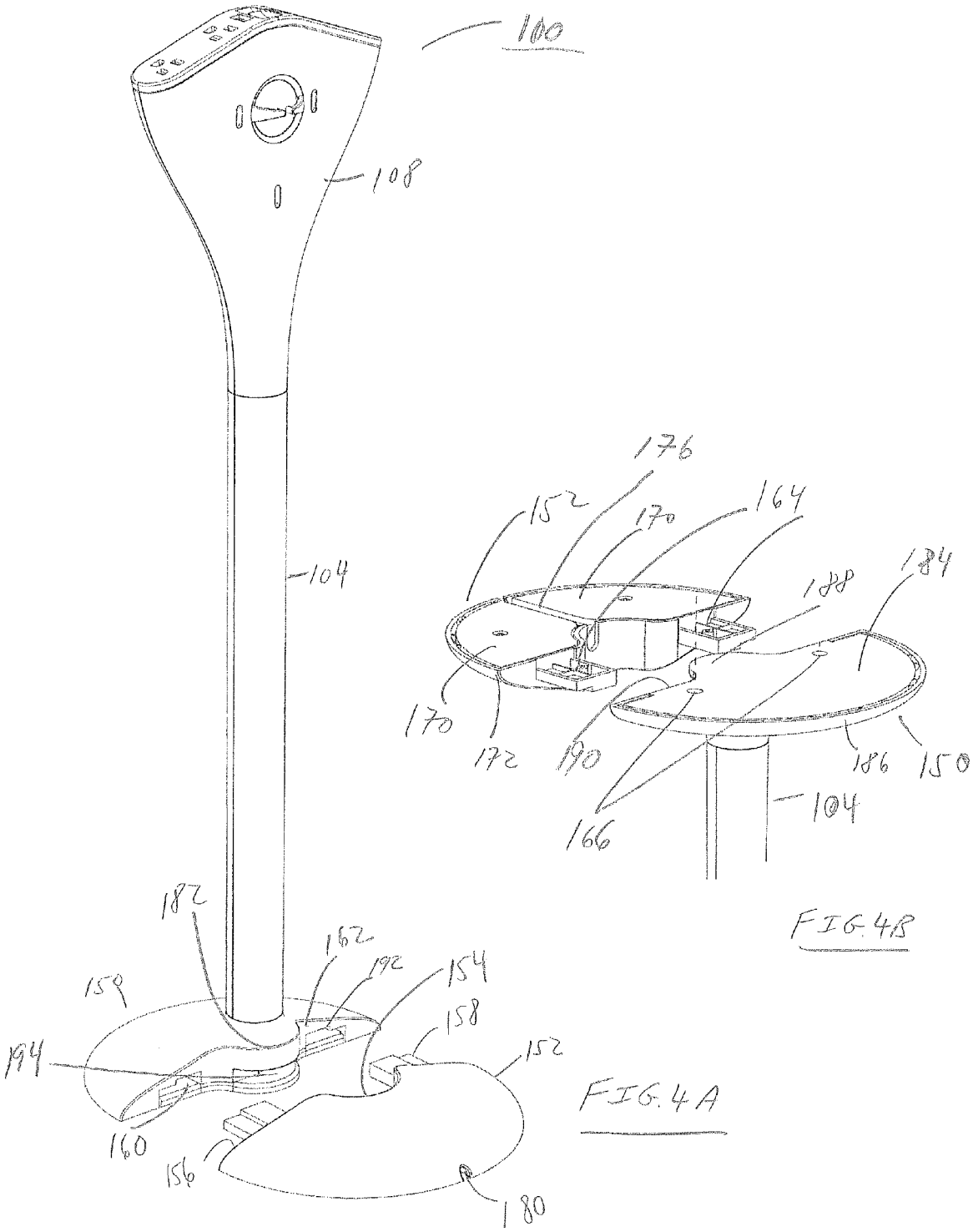
FIG. 4A is a perspective view of the electrical plug system of FIGS. 1 and 3A shown without the device holder and shown with a portion of a base of the system disassembled.
FIG. 4B is a bottom perspective view of a lower portion of the system shown in FIG. 4A.

FIG. 4A shows the base 102 of the electric plug system 100 in one configuration in which the base 102 is separated into a front base 150 and a rear base 152. The front base 150 is shown attached to the vertical support 104, while the rear base 152 is separated from the front base 150 and the vertical support 104. The front base 150 is weighted with weights or plates 184 (FIG. 4B) to support the vertical support 104 and the socket block 106 in their vertical orientation. With the rear base 152 detached, the remainder of the electrical plug system 100 can be placed closer to a wall than would be possible with the rear base 152 attached.

As shown in FIG. 4A, the rear base 152 is generally semicircular of a first diameter, but has a semicircular recess 154 of a second, smaller diameter formed in the center of a front side 156 of the rear base 152. Tabs (connector elements) 158 extend from the front side 156 of the rear base 152. The tabs 158 have a stepped profile that corresponds to a mating profile of slots 160 formed in a rear side 162 of the front base 150. Owing to the stepped profile of the tabs 158 and slots 160, the slots 160 are constructed to receive the tabs 158 in only one relative orientation of the rear base 152 and front base 150. It will be appreciated that the arrangement of the tabs 158 and slots 160 prevents assembly of the rear base 152 upside down with respect to the front base 150. The tabs 158 have holes 164 (FIG. 4B) that align with holes 166 in the notches 160 to receive screws 168 (FIG. 6) to retain the front base 150 and rear base 152 together.

As shown in FIG. 4B, the rear base 152 includes a plurality of rear base plates 170 and a rear base plate cover 172 that attaches to both of the rear base plates 170 with screws 174. In one embodiment, the rear base plates 170 are formed from a heavy metal and act as a weight. In the embodiment shown in FIG. 4B, the rear base plates 170 generally form quarter circles. The rear base plates 170 are spaced from each other a sufficient amount to permit access to a base cord channel 176 formed in the rear base plate cover 172. The base cord channel 176 recesses the cord 178 (FIG. 6). The channel 176 also receives and directs the power cord 178 from the vertical support 104 radially outward to a rear cord opening 180 (as best seen in FIGS. 4A and 6) in the rear base plate cover 172.

The rear side 162 of front base 150 is generally planar in the regions surrounding the slots 160, but has a semicircular extension 182 formed at the center of the rear side 162 adjacent to the vertical support 104. The semicircular extension 182 is constructed to be received in the semicircular recess 154 formed in the front side 156 of the rear base 152. The front base plate 184 is generally semi-circular and has a semicircular portion 188 extending centrally from a rear edge 190. The front base plate 184 is made from a heavy metal and acts as a weight. The notches 160 in the front base 150 are formed between grooves 192 formed in the front base cover 186 and the front base plate 184. Also, a central cord opening 194 is formed in the semicircular extension 182 between the front base cover 186 and the front base plate 184. When the front base 150 and the rear base 152 are attached to each other, the central cord opening 194 communicates with the base cord channel 176 to further route the power cord 178 through the front base 150.

FIG. 6 shows an exploded assembly of the electrical plug system 100. A support post 196 is attached at a lower end to an upper side 198 of the front base plate 184. The support post 196 is attached at the semicircular portion 188 at a position on the front base plate 184 corresponding to the center of the base 102. The support post 196 shown has a generally square cross section forming a channel through which the power cord 178 is routed. A slot 200 at the lower end of the support post 196 permits the power cord 178 to route over the semicircular detent 188 of the front base plate 184 and in the central cord opening 194 formed between the front base cover 186 and the front base plate 184. Holes 202 are formed in at least one of the sides of the support post 196 for securing the support post 196 to the vertical support 104, as described below. The front base cover 186 has a square opening 204 formed vertically therethrough to receive the power cord 178 and the support post 196. The front base cover 186 nests over the front base plate 184 and attaches thereto with screws 206.

The vertical support 104 includes a front support cover 208 and a rear support cover 210. The front support cover 208 is attached to a side of the support post 196 with screws 210, as noted above. The rear support cover 210 attaches to the front support cover 208 by snap fit connection. It will be appreciated by those of skill in the art that other connection arrangements can be implemented to connect the rear support cover 210 to the front support cover 208. The front and rear support covers 208, 210 have a plurality of ribs 212, which are generally u-shaped. When the front and rear support covers are attached to each other, the ribs 212 surround the power cord 178 and the support post 196 to form a central channel from the upper end to the lower end of the vertical support 104. The power cord 178 is thus routed from the base 102 to the upper end 108 of the vertical support 104 through the central channel formed in the vertical support 104.

FIG. 6 also details the construction of the upper end 108 of the vertical support 104. Specifically, FIG. 6 shows the construction of the socket block 106 and a housing 214 formed by a front cover 216 and a rear cover 218. The front cover 216 connects to the rear cover 218 with a snap fit connection, although those of ordinary skill in the art will appreciate that other connection types are possible. Connection flanges 220 extend from the lower ends of the front and rear covers 216, 218. The outer surface of the connection flanges 220 has a stepped profile that corresponds to a stepped profile of notches 222 formed in the upper ends of the front and rear support covers 208, 210. The notches 222 are constructed to receive the connection flanges 220. The inner surfaces of the connection flanges 220 include a central groove 224 having u-shaped ribs 226. The power cord 178 is routed in the central groove 224. When the front cover 216 and the rear cover are connected to each other around the power cord 178, the flanges 220 are secured to the front cover 208 of support 104 with screws 226. Tightening the screws 226 presses the ribs 226 of the central grooves 224 into the power cord 178 to strain relieve the power cord 178.

The housing 214 houses the socket block 106. The socket block 106 includes a plug cover 236. The switch 116 is located centrally in the plug cover 216. The plug cover 216 has a plurality of openings to receive male electrical plugs and universal serial bus (USB) connectors. The socket block 106 also includes a USB printed circuit board 238, which includes receptacles for electrically connecting to USB connectors. The socket block 106 further includes a bussbar holder 240 to electrically connect to the male electrical plugs.

Also housed in the housing 214 are various electrical components for distributing power from the power cord 178 to the bussbar holder 240. In at least one embodiment, such various electrical components include a circuit board, power bussbars, a ground bussbar, and a USB bussbar.

FIG. 6 also shows details of the construction of the device holder 110, described above. As shown in FIG. 6, the device holder 110 is constructed of a rear portion 222 and support rack 133 connected together with screws 225. The support rack 133 has a generally rectangular notch 228 formed in a rear side 230, which is otherwise generally planar.

In one embodiment, the support 104 is constructed to locate the socket block 106 at between twenty-four and forty-two inches above the horizontal floor surface. For example, in one embodiment the support 104 is constructed with a telescoping arrangement to adjust the height of the socket block 106 with respect to the horizontal floor surface. For example, the support 104 may employ one or more of the telescoping arrangements described in U.S. patent application Ser. No. 13/849,621.

In use, a user may attach device holder 110 to the upper end 108 of support 104. The user can, for example, plug a cord of a cell phone into the socket block 106 and insert the cell phone into front pocket 146. Also, a user can, for example, plug a cord of a tablet computer into the socket block 106 and insert the tablet computer into rear pocket 136. The cords of the cell phone and tablet computer can be retained in cord guides 126 while the devices are held in the device holder 110. Also, the plugs of the cell phone and tablet computer can, depending on the configuration of the cord of the cell phone and tablet computer, can either be a male electrical plug or a universal serial bus plug, which are plugged into the respective female electrical plug or universal serial bus receptacle in socket block 106. It should also be understood that depending on the available space in pockets 136 and 146, and the sizes of the devices, one or more devices may fit in one of the pockets. For example, two or more cell phones may fit in the front pocket 146.

Also, in use, a user may wish to configure electric plug system 100 so that the rear base 152 is detached from front base 150 and/or the device holder 110 is detached from the support 104. For example, a user may wish to so configure the electric plug system 100 in order to locate the system 100 closer to a wall to save space. The front base 150 is weighted with plate 184. The plate 184 weights the front base 150 sufficiently to prevent the system 100 from falling over even when the device holder 110 is attached to the support 104 and is holding devices in all of its pockets 136 and 146. In one embodiment, the weight of plate 184 is between 1.5 and 1.75 pounds and the weight of each plate 170 is between 0.5 and 0.6 pounds. Thus, the combined weight of plate 184 and both plates 170 is between 2.5 and 3.0 lbs. In another embodiment, the weight of plate 184 and front base cover 186 is between 1.5 and 1.75 pounds and the weight of both plates 170 and rear base plate cover 172 is between 1.0 and 1.2 pounds.

There have been described and illustrated herein a preferred embodiment of an electric plug system. While a particular embodiment of the invention has been described, it is not intended that the invention be limited thereto, as it is intended that the invention be as broad in scope as the art will allow and that the specification be read likewise. Moreover, while particular configurations have been disclosed in reference to an electric plug system it will be appreciated that other configurations could be used as well. It will therefore be appreciated by those skilled in the art that yet other modifications could be made to the provided invention without deviating from its spirit and scope as claimed.

What is claimed is:

1. An electric plug system for use in conjunction with a wall or floor electrical outlet, the electric plug system for powering electrically powered devices having cords terminating in male plugs, comprising:

a stabilizing base constructed to stand on a horizontal floor surface;

a vertical support element supported by and extending from the base and defining a vertical axis;

an electrical socket block coupled to a top portion of the vertical support element and supported thereby, the electrical socket block having a plurality of electrical sockets adapted to receive the plugs of the devices;

a device holder removably attached to the vertical support element, the holder including at least one pocket constructed to hold at least one of the powering electrically powered devices; and an electrical wire extending from the horizontal electrical socket block, down the vertical support element, and along or through the base and there-beyond, the electrical wire terminating in an electrical plug constructed to plug into the wall or floor electrical outlet.

2. The electrical plug system according to claim 1, wherein:

at least one pocket is dimensioned to receive a tablet computer.

3. The electrical plug system according to claim 2, wherein:

the device holder has a plurality of adjacent pockets having different depths.

4. The electrical plug system according to claim 1, wherein:

the electrical sockets are oriented along one or more surfaces that are obliquely oriented relative to a longitudinal axis of vertical support.

5. The electrical plug system according to claim 4, wherein:

an upper edge of the device holder is aligned with an upper surface of the socket block.

6. The electrical plug system according to claim 1, wherein:

the electrical sockets include a plurality of female electrical sockets and at least one universal serial bus socket.

7. The electrical plug system according to claim 1, wherein:

the device holder has a cord guide for retaining the cords of the powering electrically powered devices.

8. The electrical plug system according to claim 7, wherein:

the cord guide is positioned between the device holder and the top portion of the vertical support element.

9. An electric plug system for use in conjunction with a wall or floor electrical outlet, the electric plug system for powering electrically powered devices having cords terminating in male plugs, comprising:

a reconfigurable stabilizing base constructed to stand on a horizontal floor surface, wherein in a first configuration the stabilizing base includes a first base portion and a second base portion removably attached to one another and in a second configuration the stabilizing base consists of the first base portion detached from the second base portion a vertical support element supported by and extending from the first base portion of the base and defining a vertical axis;

an electrical socket block coupled to a top portion of the vertical support element and supported thereby, the electrical socket block having a plurality of electrical sockets adapted to receive the plugs of the devices;

a device holder removably attached to the vertical support element, the holder including a plurality of pockets, each pocket constructed to hold at least one of the plurality of the powering electrically powered devices; and an electrical wire extending from the horizontal electrical socket block, down the vertical support element, and along or through the base and there-beyond, the electrical wire terminating in an electrical plug constructed to plug into the wall or floor electrical outlet.

10. An electric plug system for use in conjunction with a wall or floor electrical outlet, said electric plug system for powering electrically powered devices having cords terminating in male plugs, comprising:

a reconfigurable stabilizing base constructed to stand on a horizontal floor surface, wherein in a first configuration the stabilizing base includes a first base portion and a second base portion removably attached to one another and in a second configuration the stabilizing base consists of the first base portion detached from the second base portion;

a vertical support element supported by and extending from the first base portion of the base and defining a vertical axis;

an electrical socket block coupled to a top portion of the vertical support element and supported thereby, the electrical socket block having a plurality of electrical sockets adapted to receive the plugs of the devices; and an electrical wire extending from the horizontal electrical socket block, down the vertical support element, and along or through the base and there-beyond, the electrical wire terminating in an electrical plug constructed to plug into the wall or floor electrical outlet.

11. The electrical plug system according to claim 10, wherein:

the first base portion defines a first hole that receives the vertical support element and the electrical wire.

12. The electrical plug system according to claim 10, wherein:

the first base portion includes at least one weight element that stabilizes the vertical support element in the second configuration.

13. The electrical plug system according to claim 10, wherein:

the first base portion and the second base portion are asymmetric about the vertical support element.

14. The electrical plug system according to claim 13, wherein:

at least one slot is formed in the first base portion, at least one tab is formed in the second base portion, the slot constructed to receive the tab to couple the first and second base portions.

15. The electrical plug system according to claim 14, wherein the second base portion defines a channel to guide the electrical wire radially outward from the base.

16. The electrical plug system according to claim 10, further comprising:

a cord guide for retaining the cords of the powering electrically powered devices along the outside of the vertical support.

17. The electrical plug system according to claim 10, further comprising:

a device holder removably attached to the vertical support element and constructed to hold at least one of the powering electrically powered devices.

18. The electrical plug system according to claim 10, wherein:

the electrical sockets include a plurality of a female electrical sockets and at least one universal serial bus socket.

19. The electrical plug system according to claim 18, wherein:

the plurality of female electrical sockets and the at least one universal serial bus socket are arranged in at least one row, and the electrical socket block includes at least one switch for controlling power to at least one of the female electrical sockets and universal serial bus sockets.

20. The electrical plug system according to claim 19, wherein:

the plurality of female electrical sockets and universal serial bus sockets are arranged facing upwards such that the electrical devices having male plugs are connected to the plurality of female electrical sockets by movement of said male plugs substantially vertically downward.

21. An electric plug system for use in conjunction with a wall or floor electrical outlet, said electric plug system for powering electrically powered devices having male plugs, comprising:

a stabilizing base adapted to stand on a horizontal floor surface;

a vertical support supported by and extending from said base;

an electrical socket block coupled to a top portion of said vertical support and supported thereby, said electrical socket block having a plurality of female electrical sockets adapted to receive the male plugs of the devices, wherein said vertical support is adapted to locate said electrical socket block at between twenty-four and forty-two inches above the horizontal floor surface; and an electrical wire extending from said electrical socket block, down said vertical support, and along or through said base and there-beyond, said electrical wire terminating in a male electrical plug adapted to plug into the wall or floor electrical outlet, wherein said stabilizing base defines a first hole that receives said electrical wire extending down said vertical support and a second hole coupled to said first hole through which said electrical wire runs.

22. The electrical plug system according to claim 21, wherein:

said plurality of female electrical sockets are arranged in at least one row adjacent each other.

23. The electrical plug system according to claim 22, wherein:

said electrical socket block includes at least one switch for controlling power to said plurality of female electrical sockets.

24. The electrical plug system according to claim 21, wherein:

said plurality of female electrical sockets are arranged facing forwards such that the electrical devices having male plugs are connected to said plurality of female electrical sockets by movement of said male plugs horizontally.

* * * * *